US005288045A

United States Patent [19]

Edwards et al.

[11] Patent Number: 5,288,045

[45] Date of Patent: Feb. 22, 1994

[54] CHAIR BASE

[75] Inventors: Thomas M. Edwards, Wyoming; Robert A. Nagelkirk, Zeeland, both of Mich.

[73] Assignee: Herman Miller, Inc., Zeeland, Mich.

[21] Appl. No.: 97,158

[22] Filed: Jul. 26, 1993

Related U.S. Application Data

[60] Division of Ser. No. 392,721, Aug. 11, 1989, Pat. No. 5,249,768, which is a continuation-in-part of Ser. No. 205,308, Jun. 10, 1988, abandoned.

[51] Int. Cl.[5] ..... F16M 11/00

[52] U.S. Cl. ..... 248/188.7; 108/150; 248/188

[58] Field of Search ..... 248/188.7, 188.8, 188; 108/150

[56] References Cited

U.S. PATENT DOCUMENTS

| | | |
|---|---|---|
| 128,782 | 7/1872 | Bell . |
| D. 142,239 | 8/1945 | Jones . |
| 461,238 | 10/1891 | Cox et al. . |
| 1,859,223 | 5/1932 | Stevenson . |
| 1,930,021 | 10/1933 | Powell . |
| 1,933,372 | 10/1933 | Fisher . |
| 2,044,021 | 6/1936 | Schachtel . |
| 2,086,640 | 7/1937 | Reynolds . |
| 2,172,019 | 9/1939 | Brainard . |
| 2,233,986 | 3/1941 | Leech . |
| 2,311,875 | 2/1943 | Schaaf . |
| 2,350,399 | 6/1944 | Jones . |
| 2,470,397 | 5/1949 | Harter . |
| 2,587,128 | 2/1952 | Eull . |
| 2,913,208 | 11/1959 | McKinley . |
| 2,979,122 | 4/1961 | Knoll . |
| 3,151,830 | 10/1964 | Giacomini . |
| 3,174,797 | 3/1965 | Neufeld . |
| 3,186,669 | 6/1965 | Buhrmaster . |
| 3,273,178 | 9/1966 | Baruth et al. . |
| 3,281,105 | 10/1966 | Kafferlin et al. . |
| 3,391,887 | 7/1968 | Doerner . |
| 3,531,147 | 9/1970 | Johnson . |
| 3,567,278 | 3/1971 | Barecki et al. . |
| 3,617,023 | 11/1971 | Schneiderman . |
| 3,669,499 | 6/1972 | Semplonius et al. . |
| 3,682,425 | 8/1972 | Vincent et al. . |
| 3,863,876 | 2/1975 | Finkelstein et al. . |
| 3,908,946 | 9/1975 | George et al. . |
| 4,005,841 | 2/1977 | Rensland et al. . |
| 4,019,776 | 4/1977 | Takamatsu . |
| 4,084,776 | 4/1978 | Cook . |
| 4,128,274 | 12/1978 | Schmedemann . |
| 4,318,570 | 3/1982 | Adam et al. . |
| 4,789,122 | 12/1988 | Gutgsell . |

FOREIGN PATENT DOCUMENTS

| | | |
|---|---|---|
| 79530 | 5/1983 | European Pat. Off. . |
| 2925520 | 6/1979 | Fed. Rep. of Germany . |
| 226 | of 1856 | United Kingdom . |
| 1209765 | 10/1970 | United Kingdom . |

*Primary Examiner*—Alvin C. Chin-Shue

*Attorney, Agent, or Firm*—Varnum, Riddering, Schmidt & Howlett

[57] ABSTRACT

A chair base is constructed by stamping straps (16) from low carbon sheet stock, securing pairs of straps to a central hub (10) in parallel relation to one another to radiate outwardly from the central hub, and coating the straps and hub with a polyvinyl chloride coating (50). A caster socket block (20) may be secured between the two straps of each pair at an outer end (18) thereof. The central hub (10) and the caster sockets (20) may be covered by plastic shells (34).

17 Claims, 4 Drawing Sheets

CHAIR BASE

BACKGROUND OF THE INVENTION

1. Cross-Reference to Related Applications

This application is a continuation-in-part of application Ser. No. 205,308 filed on Jun. 10, 1988, abandoned and a div. of application Ser. No. 07/392,721 filed Aug. 11, 1989, U.S. Pat. No. 5,249,768, issued Oct. 5, 1993.

2. Field of the Invention

This invention relates to a metal chair base for office chairs and the like, and more particularly to a novel construction of a chair base which is simplified, low cost, lightweight and highly durable.

3. State of the Prior Art

Various chair bases of the kind having support legs radiating from a central column or pedestal have long been employed for the support of office chairs and other pieces of furniture suitable for office and home alike. Such bases are popular because of their aesthetic qualities and adaptability for use with various tilt and swivel mechanisms.

In the highly competitive furniture industry, it is desirable to provide chair bases that are highly durable, yet light in weight and relatively inexpensive to produce. One common type of chair base assembly employs a plurality of tubular members arranged about a central hub. Examples can be found in U.S. Pat. No. 4,005,841 to Rensland et al., issued Feb. 1, 1977 and U.S. Pat. No. 2,470,397 to Harter, issued May 17, 1949. While such tubular chair bases may be light in weight, they lack the necessary strength, particularly in a direction lateral to the tubular member, which may be required in a modern office environment.

Other types of chair base assemblies common in the art include a plurality of tapered legs disposed radially around a central hub and secured to the hub by welding. One example of such a chair base is disclosed in U.S. Pat. No. 3,281,105 to Kafferlin et al., issued Oct. 25, 1966. The leg elements and the central column in such bases are necessarily made of relatively heavy gauge material in order to sustain normal stresses and to prevent flexure and deformation of the legs, particularly in the area of the welded joints. Flanges are also frequently used to provide additional strength to the legs to prevent deformation. Such bases are generally durable, but are nevertheless heavy, and require more material in their construction thus increasing their cost and weight.

Other welded joints have been proposed in U.S. Pat. Nos. 3,682,425 to Vincent et al., issued Aug. 8, 1972 and U.S. Pat. No. 4,084,776 to Cook, issued Apr. 18, 1978 which address the problem of weaknesses introduced by welding. It is known to use stamped plates which are bent in U-shape to form the legs. This U-shaped part is then welded to the hub and painted without any extensive finishing operations. The U-shape may open upwardly or downwardly. A U-shaped cover made of molded plastic or chromeplated steel at least partially conceals the formed legs.

It is also known to use plastisol or similar plastic like coatings to cover wire products, including wireform chairs, baskets and the like. It is also known to use plastisol to coat die cast aluminum chair parts.

None of these expedients, however, obtain an inexpensive, yet highly durable chair base, using low-cost steel, for example, while simultaneously maintaining a relatively light weight using simple construction.

SUMMARY OF THE INVENTION

The invention provides a method of making a chair base typically comprising a seat mounting means with multiple legs secured thereto. The method comprises the steps of forming a plurality of straps from low carbon steel; securing pairs of the straps to the seat mounting means in parallel relation to one another to form the legs; and coating at least a portion of the straps and the seat mounting means with a coating of sufficient thickness to conceal surface imperfections and to provide an aesthetic finish. The straps are typically formed from low carbon steel sheet stock by stamping.

The straps can be secured to the seat mounting means by welding and the coating covers the welds. The method may comprise the additional step of heating the legs and the seat mounting means before the coating step. The coating typically comprises polyvinyl chloride, preferably of a thickness between 0.025 and 10 inches.

The method may optionally include the step of securing a caster mounting means to an outer portion of the legs prior to the coating step. Also, the seat mounting means may comprise a hub formed of tubular steel.

A chair base constructed according to the invention provides a low-cost but very sturdy chair base, and one which is very attractive in appearance. The low cost and strength are derived from the use of ordinary low carbon steel which is joined by conventional welding techniques. The chair base is made decorative as well as being protected by the use of plastic coatings and coverings over the steel parts and weldments. The coatings and coverings are easily and inexpensively applied, using conventional techniques. Further, the coatings and covers can be of any color which has the advantage of complementing any color in the chair. Thus, the chair bases can be of various different colors as desired to complement the color of the upholstery or shell of the chair.

BRIEF DESCRIPTION OF DRAWINGS

The invention will now be described with reference to the accompanying drawings in which.

DETAILED DESCRIPTION OF THE PREFERRED EMBODIMENT

Figure 1:
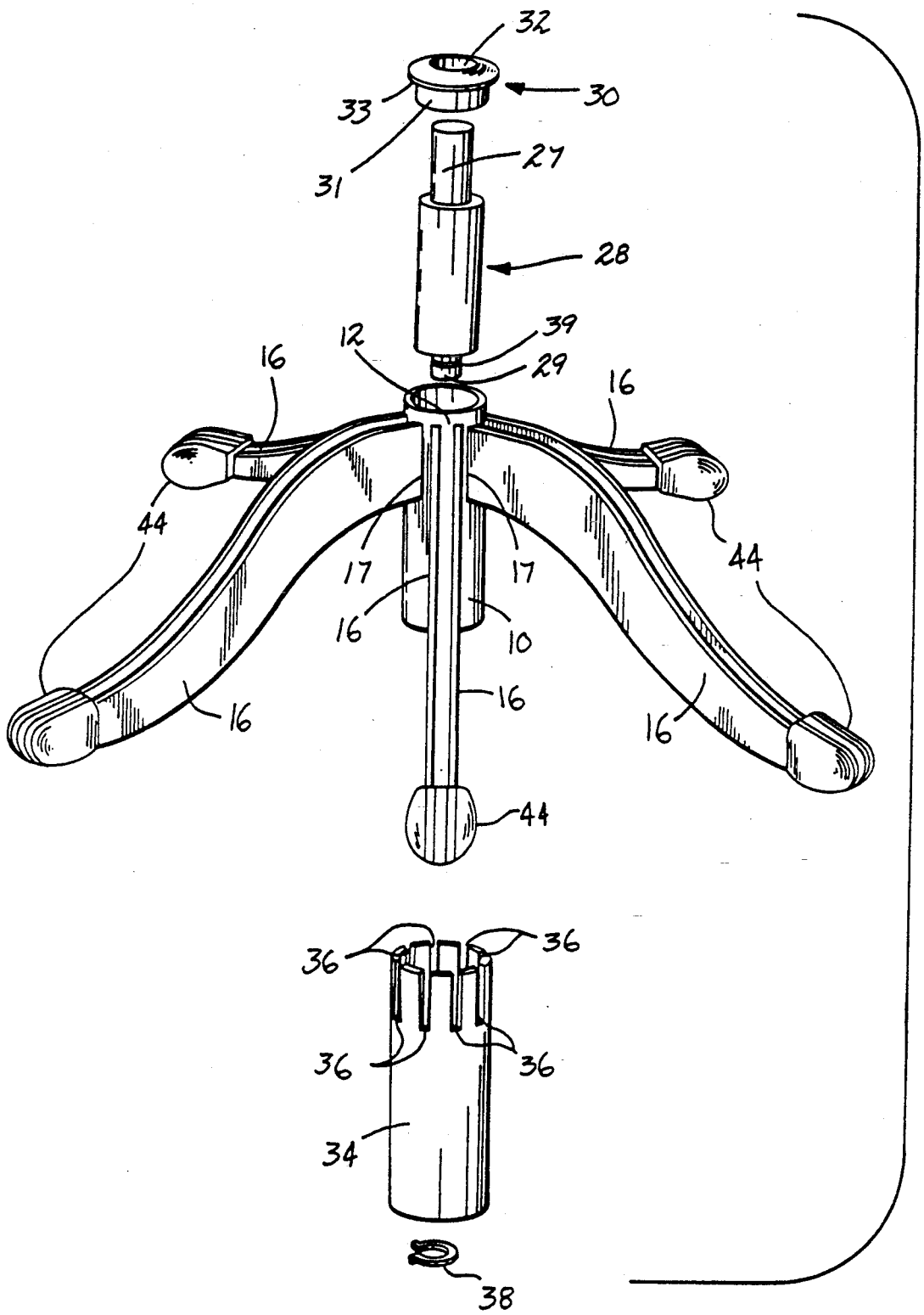
FIG. 1 is a partially exploded isometric view of a chair base according to the invention.
Figure 3:
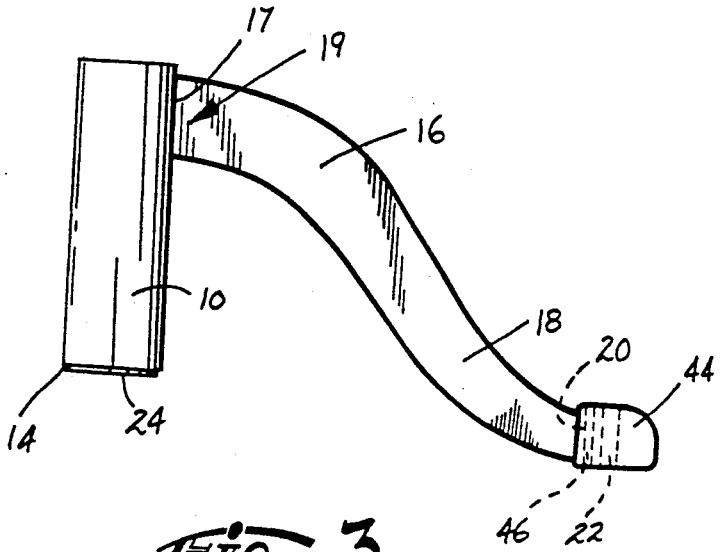
FIG. 3/is an elevational view of the chair base of FIGS. 1 and 2 taken along line 3—3 of FIG. 2 with all but one of the legs removed for clarity.

Referring first to FIG. 1, the chair base comprises a steel hollow central hub 10 having an upper portion 12 and a lower end 14 around which are spaced a series of legs, each formed of a pair of steel straps 16. The hub is preferably cylindrical in shape, but may be any shape which is aesthetically pleasing to complement the entire chair design. The straps 16 are roughly shaped in the form of a quarter sine wave and are arranged in parallel pairs with each strap welded to the upper portion 12 of the central hub 10 such that the pairs extend radially outwardly in an equally spaced apart configuration. The straps 16 of each pair are thus not directly connected along their span, there being an open space between them. In the embodiment shown, they are arranged in five pairs to form five legs, but more or fewer pairs may be provided, depending upon the particular desired configuration of the chair base. As can be seen in FIG. 3, the shape of the straps 16 is such that outer ends 18 of the straps 1 6 are lower than upper ends 19 thereof, and they extend downwardly below the plane of the lower end 14 of the central hub 10. Thus, when weight is applied to the central hub, the force will be transferred laterally outwardly and downwardly through each pair of straps 16. Existing chair bases with straight legs radiating outwardly from a central hub tend to transfer the downward force in a shear direction transversely through the leg. The quarter sine wave shape of the straps 16 translates the downward force laterally across the span of the leg, thus permitting higher forces to be transmitted by a relatively thinner material. Further, the paired configuration tends to resist flexure of the straps, thus permitting the use of relatively thin straps and consequently lessening the cost of materials. Also, the chair base occupies less floor space to sustain a given load than existing chairs, and permits more space for freedom of foot movement underneath the chair.

The hub 10 and straps 16 are preferably formed of low-carbon steel. An example of a typical low-cost material for construction of the parts would be 1020 coiled steel, hot rolled and pickled in oil. The straps 16 are stamped from the blank steel having a thickness of approximately 11 gauge (approximately ⅛th of an inch), and the hub 10 is formed from similar low-carbon steel tubing of a nominal ⅛th-inch thickness in the wall. The straps 16 are welded to the hub 10 by conventional weldments 17 at the respective junctions. No milling or deburring of the parts is necessary, nor is any grinding of the weldments.

Figure 2:
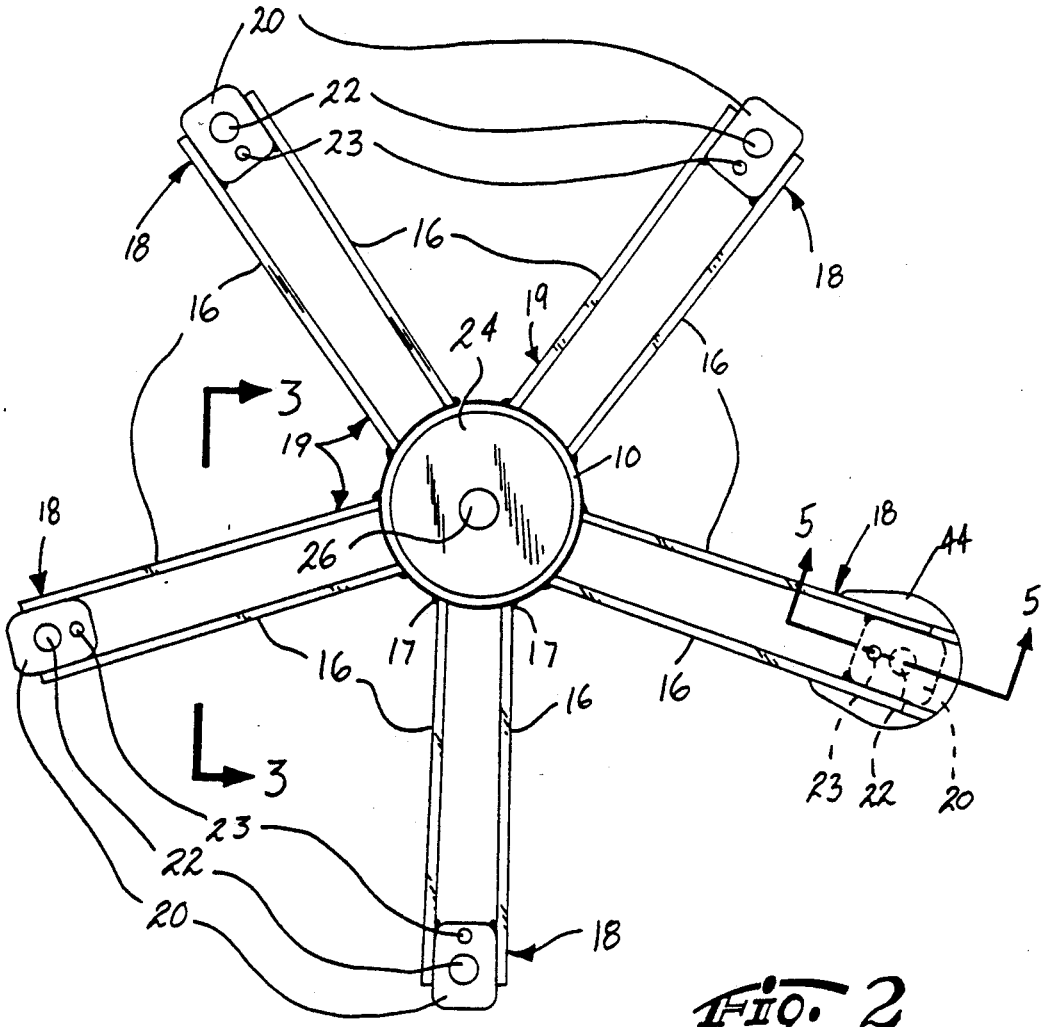
FIG. 2 is a top plan view of the chair base shown in FIG. 1 with all but one of the decorative parts removed.

As shown in FIG. 2, the outer end 18 of each pair of straps 16 mounts a caster socket block 20 interposed in the space between the two straps of each pair and preferably welded thereto. As with the hub 10 and straps 16, no finishing operations are necessary, after welding. A socket 22 in each caster socket block receives the spindle of a conventional caster, not shown. A smaller bore 23 parallels the socket 22 in each caster socket block, and is spaced inwardly of hole 22 with respect to the hub 10. An end plate 24 with a central aperture 26 covers the lower end 14 of the central hub 10. (See FIG. 3.)

Figure 4:
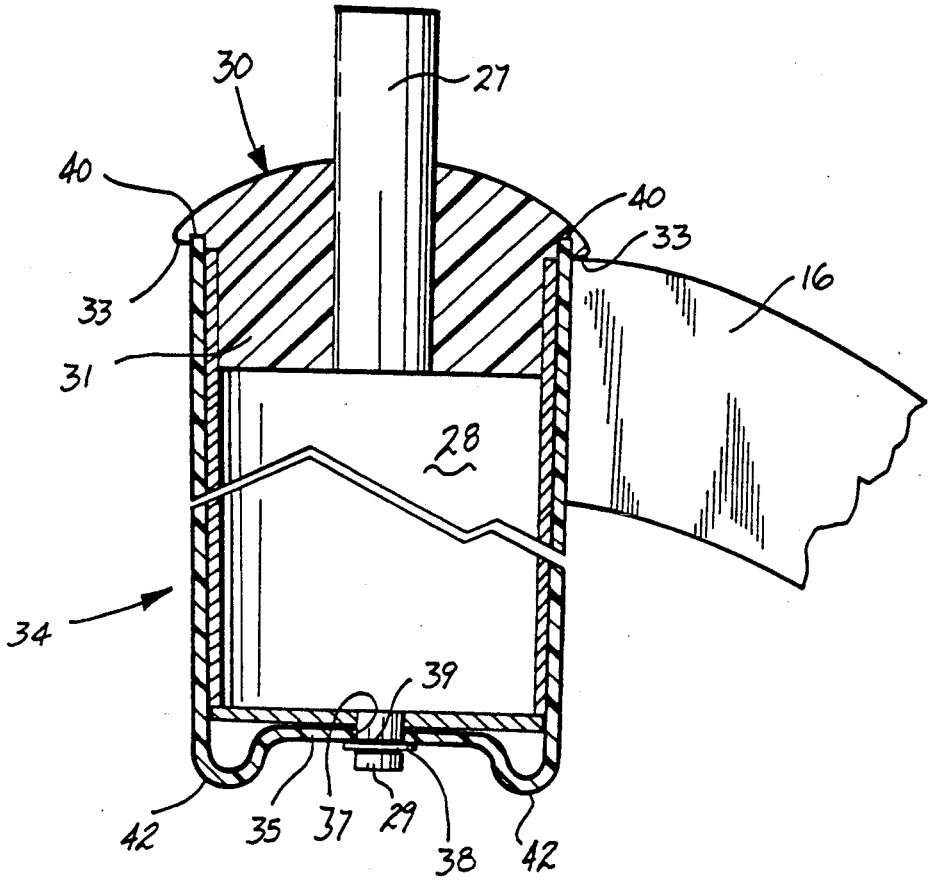
FIG. 4 is a sectional view in elevation and taken through the central hub of the chair base of FIG. 1 illustrating the interconnection of the parts.

The central hub 10 serves as a means to support a chair seat (not shown). Referring again to FIG. 1, the hub 10 may be internally dimensioned to receive, for example, a conventional pneumatic air cylinder mechanism 28 for height adjustment of a chair seat. Such chair seat forms no part of this invention. Alternatively, a conventional mechanical height adjustment mechanism (not shown) may be inserted into the central hub 10. The chair adjustment mechanism 28 further comprises a shaft 27 extending upwardly from the top thereof on which a chair seat may be mounted, and a stubshaft 29 extending from the bottom. A cap 30, preferably made of plastic, and having a central aperture 32 covers the top of the hub 10 and the shaft 27 of the chair adjustment mechanism 28 in order to protect the mechanism 28 and the hub 10 from abrasions and also to provide an aesthetic appearance. As shown in FIG. 4, the cap 30 comprises a plug portion 31 dimensioned to fit snugly into the hollow interior of central hub 10. The central aperture 32 extending through the cap 30 is thus elongated, such that when the cap 30 is mounted on the hub 10, the shaft 27 of the chair adjustment mechanism 28 extends through the aperture 32 and is stabilized and supported thereby. The cap 30 also has an annular shoulder 33 which serves to limit movement of the cap 30 into the hub 10. An annular groove 40 on the shoulder 33 extends circumferentially around the cap, exterior to the hub 10, for a purpose to be described hereinafter.

A cylindrical shell 34, also preferably of plastic, is open at an upper end thereof, and has a bottom 35 closing a lower end thereof to form a cup. A series of elongate slots 36 extends downwardly from the open end, through a longitudinal distance approximately equal to the length of the junction between each straps 16 and the hub 10. The shell 34 covers the central hub 10 from the bottom such that the straps 16 are received in slots 36, allowing the cylindrical shell 34 to cover the entire central hub 10 and to rest in juxtaposition to the cap 30. An upper rim 41 of the shell 34 is received in the groove 40 of the shoulder 33 to provide a secure connection between the cap 30 and the shell 34. The bottom 35 of the shell 34 has a centrally located aperture 37 through which the stubshaft 29 of the chair adjustment mechanism 28 extends. A fastener 38 such as a conventional C-clip mounts an annular groove 39 on the stubshaft 29 to retain the shell 34 on the hub 10, and also to secure the chair adjustment mechanism 28 in the hub 10. An annular rib 42 on the perimeter of the bottom 35 of the shell 34 extends downwardly and serves to conceal the C-clip 38 and contribute to the aesthetic appearance of the chair base.

Figure 5:
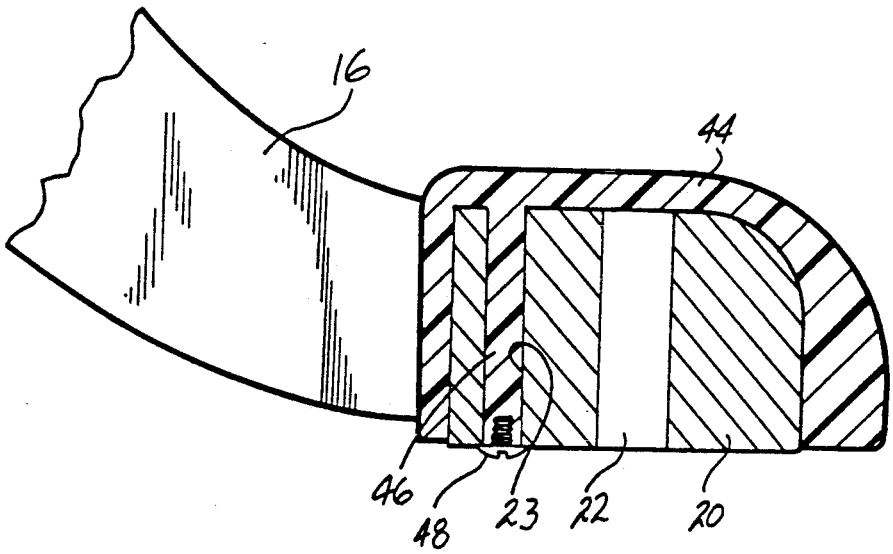
FIG. 5 is a sectional view in elevation and taken along line 5—5 of FIG. 2.

Caster socket covers 44, also preferably made of plastic, are dimensioned to cover the outer end 18 and caster socket 20 of each pair of straps 16 to provide protection from abrasions and also to enhance the appearance of the chair base. As can be seen in FIG. 5, a finger 46 extends downwardly from the inside top of the caster socket cover 44 into the smaller hole 23 of the caster socket 20. A screw 48 inserted through hole 23 from the bottom and into the finger 46 secures the cover 44 in place. Covers 44 may be of any shape consistent with the overall appearance of the chair so long as each adequately covers the socket block 20. For example, the exterior of the cover may continue the lines of the straps 16. All decorative and protective plastic parts 30, 34, 44 may be colored to provide a pleasing and attractive appearance which will complement any chair seat mounted to the base, and may be easily formed using conventional injection-molding techniques.

Figure 6:
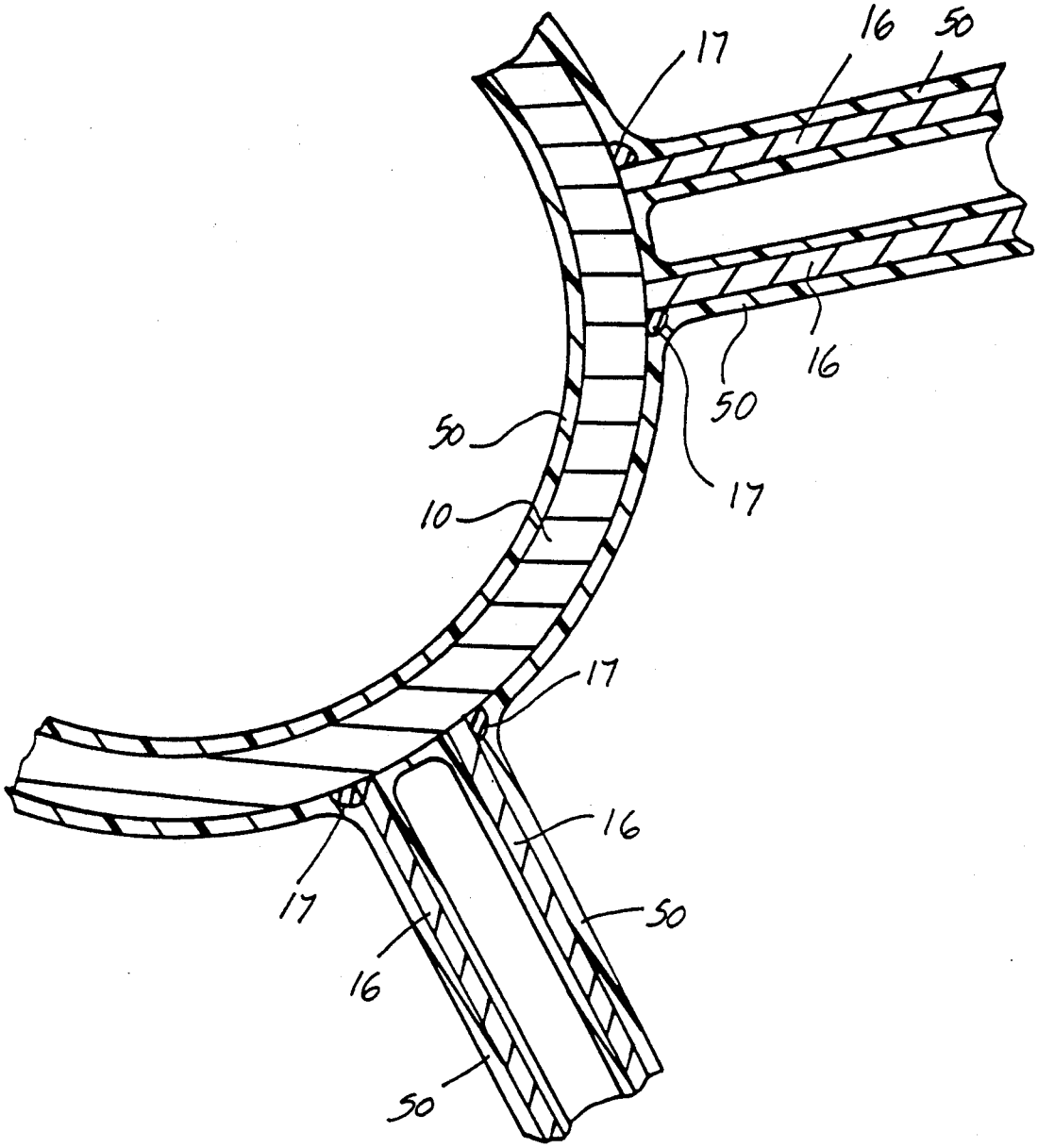
FIG. 6 is fragmentary sectional view of a portion of the hub and straps with coating.

Once all weldments 17 in the base are completed, a suitable protective coating 50 is applied to all parts, as shown in FIG. 6. Preferably, the base is heated to a temperature of 300 to 400 degrees by a radiant/hot-air convection oven, and then dipped into a vat of plastisol. Plastisol typically comprises polyvinyl chloride, and may be colored and textured to match the injection-molded plastic parts. Using conventional coating techniques, the base is retracted from the plastisol. Preferably, the plastisol process should obtain a thickness of approximately 0.050 inches on the surface of the metal parts. Because some portion of the base would be submerged in the uncured plastisol longer than another portion of the base, it is preferable that the base be dipped upside down so that the plastisol coating on the top of the base near the upper portion 12 of the hub 10 may be thicker than the plastisol coating at the ends 18 of the legs near the caster sockets 20. This plastisol process enables the chair base to be constructed at significantly less cost because secondary operations such as forming, coining, rounding, or similar finishing operations are unnecessary. Furthermore, the covers 30, 34, and 44 conceal any unsightly weldments which may not otherwise be covered by the plastisol. In addition, the thickness of the Plastisol provides a finished visual appearance at the joints, with a pleasing tactile and textured feeling on the metal parts.

It can readily be seen that the invention described herein provides a highly durable, low-cost chair base which is relatively light in weight while maintaining a high degree of stability and strength. The simple, conventional materials and simplified construction permit a substantial savings in material and labor costs, and also allow flexibility in choosing aesthetically pleasing and novel designs.

A chair base constructed according to the invention need not be specifically adapted for a movable swivel chair or tilt chair. The invention is easily adaptable to stationary chairs wherein the legs are secured to a bracket for supporting a chair seat and feet, rather than casters, are provided at the lower ends of the legs. Further, the legs may be mechanically secured to the seat mounting means without welding.

Other reasonable variations and modifications are possible within the scope of the foregoing disclosure and drawings without departing from the spirit of the invention which is defined by the appended claims.

We claim:

1. A method of making a chair base having seat mounting means and multiple legs secured thereto, said method comprising the steps of:

forming a plurality of straps from low-carbon steel;

securing pairs of said straps to the seat mounting means in parallel relation to one another to form said legs;

heating said legs and said seat mounting means; and coating at least a portion of said straps and said seat mounting means with a coating of sufficient thickness to conceal surface imperfections therein and to provide an aesthetic finish.

2. A method of making a chair base according to claim 1 wherein said straps are formed by stamping from sheet stock.

3. A method of making a chair base according to claim 2 wherein said pairs of straps are secured to said seat mounting means by welding and said coating covers the welds.

4. A method of making a chair base according to claim 3 wherein said coating comprises polyvinyl chloride and the thickness of said coating is between 0.025 and 0.10 inches.

5. A method of making a chair base according to claim 4 and further comprising the step of securing a caster mounting means to an outer portion of said legs prior to the coating step.

6. A method of making a chair base according to claim 5 wherein said seat mounting means comprises a hub formed of tubular steel and said legs are secured to said hub to extend radially therefrom.

7. A method of making a chair base according to claim 6 and further comprising the step of mounting a discrete cover to said seat mounting means.

8. A method of making a chair base according to claim 1 wherein said pairs of straps are secured to said seat mounting means by welding and said coating covers the welds.

9. A method of making a chair base according to claim 8 and further comprising the step of securing a caster mounting means to an outer portion of said legs prior to the coating step.

10. A method of making a chair base according to claim 1 wherein said coating comprises polyvinyl chloride and the thickness of said coating is between 0.025 and 0.10 inches.

11. A method of making a chair base according to claim 1 and further comprising the step of securing a caster mounting means to an outer portion of said legs prior to the coating step.

12. A method of making a chair based according to claim 1 wherein said seat mounting means comprise a hub formed of tubular steel and said legs are secured to said hub to extend radially therefrom.

13. A method of making a chair base according to claim 12 and further comprising the step of mounting a discrete over to said seat mounting means.

14. A chair base having a seat mounting means comprising a hub formed of tubular steel; a plurality of legs fixed to said seat mounting means, each leg formed by a pair of straps spaced apart in parallel configuration, each strap formed of a low-carbon steel stamping and welded at one end thereof to said seat mounting means; said seat mounting means, and said legs having a coating of sufficient thickness to conceal the welds and surface imperfections therein.

15. A chair base according to claim 14 wherein said legs are secured to said hub to extend radially therefrom.

16. A chair base according to claim 14 wherein said straps are formed substantially in the shape of a one quarter sine wave.

17. A chair base according to claim 15 wherein said coating is polyvinyl chloride.

* * * * *